US008664882B2

(12) United States Patent
Archenhold

(10) Patent No.: US 8,664,882 B2
(45) Date of Patent: Mar. 4, 2014

(54) COLLIMATED ILLUMINATION SYSTEM USING AN EXTENDED APPARENT SOURCE SIZE TO PROVIDE A HIGH QUALITY AND EFFICIENT FIXTURE

(75) Inventor: Geoffrey Howard Gillett Archenhold, Sutton Coldfield (GB)

(73) Assignee: Radiant Research Limited, Aldridge, West Midlands (GB)

( * ) Notice: Subject to any disclaimer, the term of this patent is extended or adjusted under 35 U.S.C. 154(b) by 548 days.

(21) Appl. No.: 13/057,604

(22) PCT Filed: Aug. 5, 2009

(86) PCT No.: PCT/GB2009/001923

§ 371 (c)(1),
(2), (4) Date: Feb. 4, 2011

(87) PCT Pub. No.: WO2010/015820

PCT Pub. Date: Feb. 11, 2010

(65) Prior Publication Data

US 2011/0140633 A1 Jun. 16, 2011

(30) Foreign Application Priority Data

Aug. 5, 2008 (GB) ..... 0814255.6

(51) Int. Cl.
*H05B 37/02* (2006.01)
*F21V 7/00* (2006.01)

(52) U.S. Cl.
USPC ..... 315/291; 362/296.01

(58) Field of Classification Search
USPC ..... 315/185 R, 291, 307, 363; 362/231, 362/235, 249.06, 294, 296.01
See application file for complete search history.

(56) References Cited

U.S. PATENT DOCUMENTS

| | | | | |
|---|---|---|---|---|
| 7,014,341 | B2 * | 3/2006 | King et al. | 362/296.02 |
| 2005/0168986 | A1 | 8/2005 | Wegner | |
| 2008/0084701 | A1 | 4/2008 | Van De Ven et al. | |
| 2008/0165535 | A1 | 7/2008 | Mazzochette | |

FOREIGN PATENT DOCUMENTS

| | | | |
|---|---|---|---|
| WO | WO2009/039491 | A1 | 3/2009 |

* cited by examiner

*Primary Examiner* — Jimmy Vu
(74) *Attorney, Agent, or Firm* — Bishop Diehl & Lee, Ltd.

(57) ABSTRACT

A downlighting illumination system (100) is provided having a high light output ratio with an extended apparent source size producing a near uniform illuminance, correlated colour temperature and colour rendering index distribution across an illuminated area. The system (100) includes a power source (61), an electronic driving system (60), a light emitting source (65), a reflector (67) arranged to receive light from the light emitting source (65) and to reflect light through an output aperture in a manner that virtually extends the apparent size of the light emitting source (65) to illuminate the output aperture.

20 Claims, 8 Drawing Sheets

(b)

(a)

COLLIMATED ILLUMINATION SYSTEM USING AN EXTENDED APPARENT SOURCE SIZE TO PROVIDE A HIGH QUALITY AND EFFICIENT FIXTURE

TECHNICAL FIELD OF THE INVENTION

This present invention relates to improvements in downlighting illumination systems and particularly to such systems utilising, but not exclusive to, solid state light sources such as Light Emitting Diodes (LEDs) that produce unwanted beam striations, variations in beam colour and intensity along with poor consistency in Correlated Colour Temperature (CCT) and Colour Rendering Index (CRI) in the systems output.

BACKGROUND AO THE INVENTION

Downlighting illumination systems are used in a wide variety of configurations for general lighting, task lighting, accent lighting, emergency lighting, hospitality lighting, restaurant lighting, hospital lighting, office lighting, retail lighting, corridor lighting, and the like. The overwhelming majority of collimated downlighting illumination systems are recessed in a false or lowered ceiling however variants may be embedded in a wall or carried by a framework that is connected to a solid ceiling. Such downlighting systems are highly desirable due to the flush mounted fit with the ceiling and their deployment have become commonplace in commercial lighting applications. Downlighting illumination systems are designed specifically around the type of illumination light source used such as incandescent lamps, Compact Fluorescent Lamps (CFLs), halogen lamps, high intensity discharge lamps and more recently LEDs to list only a few however they often exhibit poor beam qualities and cause unwanted lighting effects such as beam striation, glare, unattractive scallops, uneven beam illumination causing illumination hotspots or colour variations and in the case of LEDs fringing or shadowing effects due to multiple light sources.

Due to the increased concern of man-made climate change the majority of downlighting systems currently utilise CFL lamp technologies due to improved lumen per watt characteristics as compared with the incandescent bulb. However, CFL lamps are inherently an omnidirectional light source emitting light in all directions (except where the electrical connector attaches to the body of the gas filled tube) and this leads to a significant loss of light when utilised within a downlight system. Indeed, most CFL based downlighters are significantly inefficient in converting the light generated by the CFL lamp into useful or usable light that exits from the aperture of the downlighter due to holes within the reflector system to enable the attachment of CFL lamps to a power source, re-absorption of light reflected back into the CFL lamp and the reflector design efficiency. The degree by which the efficiency of a downlighter can be measured is called the Light Output Ratio (LOR) which is the proportion of luminous flux (lumens) from the lamp(s) which emerges from the fixture and is usually a number between 0 and 1. Other things being equal, a downlight fixture having a high LOR is more efficient than one with a lower LOR. Traditional CFL downlighters offer a range of LORs from 0.3 to 0.7 depending upon the quality of the fixture design, whether diffusers are utilised and the intended beam angle and downlighter exit aperture. The LOR of a CFL downlighter (and any other omnidirectional light source) will drop significantly as both the beam angle and exit aperture decrease making CFL based downlights an inefficient means of providing high quality collimated light.

Downlighters based on LEDs which are inherently directional light emitting sources provide a significant LOR advantage over CFL based systems as the light emitted from LEDs are usually in a beam angle range from 10 degrees to 140 degrees. Unfortunately, LED based systems usually require an array of LEDs to be present in order to meet the desired number of lumens output from the lighting fixture. Such an LED array creates significant fringing and shadowing due to overlapping beam outputs from each individual LED in the array which often renders the light beam output from an LED unattractive. In addition, as the LED emitters have a small apparent size they often exhibit strong glare characteristics which is highly undesirable. In order to reduce such problems with LED based downlighters a secondary Total Internal Reflecting (TIR) collimating lens is placed above each LED to help collimate the output and then a diffuser is placed on top of this to help reduce glare. Although the TIR optics and diffuser increases the apparent source size of the LED emitting area the source sizes are still relatively small compared to the exit aperture of the downlighter and hence individual areas of bright light corresponding to individual LEDs in the array can be seen when looking directly at the downlighter exit aperture. The use of such an LED optical system still does not provide a quality beam output, increases optical losses in the system which is not desirable and adds costs to the manufacture of such a system. Other issues with LED based downlighters include significant variations in CCT and CRI of the fixture due to thermal management issues and binning of LEDs. LEDs are affected significantly by temperature and both the intensity and colour light output may change when operating temperatures vary making it difficult to maintain a constant intensity and colour output. This variation in both colour and temperature is highly undesirable and makes it exceptionally difficult to colour or intensity match groups of individual fixtures. Recent improvements in LED binning have still not solved the problems making LED based luminaires unappealing to the consumer. The CRI of today's high brightness white LEDs are generally lower than conventional light sources such as CFLs due to a low relative level of red light in the White LEDs emission spectrum however some LED illumination systems employ a combination of white and red LEDs to increase the overall CRI of such a system. Unfortunately, the spatial position of both the red and white LEDs are critical to achieve a quality beam output which is very difficult to obtain with LED arrays.

Downlighting luminaires, such as that provided by the invention, should also be easily assembled, installed and connected to power systems without the need for specialist tools. Still further, collimated downlighting illumination systems as herein described must be capable of being easily maintained so that replacement of the lamp system or driver can be readily accomplished without the need for specialised training. Components must be readily accessible and conventional mounting hardware should be suitable for the illumination systems herein disclosed.

The downlighting luminaires configured according to the present invention address the above requirements by utilising a single reflector system combined with an advanced lighting control system that extends the apparent source size of an LED or LED array to reduce or eliminate undesirable beam characteristics inherent in prior downlighting luminaires. Thus the invention provides a substantial advance in the art.

SUMMARY OF THE INVENTION

According to a first aspect of the invention, there is provided a downlighting illumination system that maintains a high light output ratio with an extended apparent source size to provide a near uniform illuminance, CCT and CRI distribution across an illuminated area comprising:

a power source to supply any one of a range of AC or DC voltages;

a means for controlling the power factor and power quality to the system;

a light emitting source with appropriate thermal conductivity and dissipation means;

a reflector comprising a reflective inner surface having an input aperture and an output aperture and arranged to receive light from said light emitting source through said input aperture and to reflect said light through the output aperture in a manner that virtually extends the apparent size of the light emitting source to illuminate the output aperture;

an electronic driving system to control the light output characteristics of the light emitting source;

a mechanical means for securing the position of the said illumination system.

By virtually extending the apparent size of the light emitting source using a reflector system that enables the majority imaging of individual components within the light emitting source it is possible to create a much larger (or extended) imaginary or virtual light emitting source at the output aperture of the reflector. This extended virtual light emitting source enables a significantly improved illuminated reflector output aperture required to create an improved uniform illuminance output downlighting illumination system. In the present invention, the illumination system can be designed such that the light emitting source and reflector configuration can create multiple virtual images of the light source or components of the light source to enable improved uniformity of CCT and CRI of the downlighting illumination system. The present invention overcomes the shadowing or fringing effects, scolloping and glare that are seen with light sources containing small, multiple light sources such as LEDs. The configuration of the present invention enables lighting fixture manufacturers to achieve a high degree of light beam collimation whilst still maintaining a high light output ratio which is practically not possible with any omnidirectional light source. Preferably, the light output ratio is>0.75 and more preferably>0.80 This present invention also significantly helps reduce manufacturing costs and system complexity as a single reflector and smaller LED light source replaces the need for a physically larger LED light source that has to place collimating optics and respective optic holders over each individual LED within the light source.

A further advantage is that, by controlling the voltage and type of voltage supplied by the power source in response to the type of light emitting source used within the downlighting illumination system it is possible to optimise the overall lumens per watt efficiency of the system. For example, today the majority of LEDs manufactured utilise DC voltage to energise which may require an AC voltage to DC voltage conversion system however it is possible to directly connect AC driven LEDs which do not necessitate the need for an AC to DC voltage conversion system and hence potentially increases the total lumens per watt system efficiency by mitigating the loses incurred within the AC to DC voltage conversion system. In at least one embodiment, the total fixture lumens per watt efficiency is greater than 40.

Other preferred features of the invention are defined in the dependent claims and may be further discussed hereinafter.

A preferred embodiment of the present invention includes a means for controlling the power factor and the quality of power to the illumination system. Power factor is defined herein as the ratio of real power to apparent power. Power factor is a simple way to determine how much of the current contributes to real power in the load. A power factor of one (unity or 1.00) indicates that 100% of the current is contributing to power in the load while a power factor of zero indicates that none of the current contributes to power in the load. Preferably, the power factor of the power supply unit or downlighting illumination system is≥0.80, more preferably≥0.9, so that, once the power is delivered to the load, the amount of current returned is minimised. This is desirable because:

1. The power transmission lines or power cord will generate heat according to the total current it carries and the resistance of the conductor in the cord resulting in unnecessary power loss
2. Additional cost may be incurred in supply power as power factor correction at the utility supply may have to be provided resulting in additional charges and wasted energy in the supply chain.

A power factor correction (PFC) circuit is preferably employed in the invention to precisely control the input current on an instantaneous basis, to match the waveshape of the input voltage. The PFC circuit may contain active and/or passive power factor correction to ensure the illumination system has a power factor correction greater than 0.8.

The PFC circuit not only ensures that no power is reflected back to the source, it also eliminates the high current pulses associated with conventional rectifier filter input circuits.

The quality of power delivered to the downlighting illumination system is critical to the overall lifetime characteristics of the system. For example, significant voltage spikes that occur from the power providers transmission lines could result in partial or catastrophic failure of the light emitting source (in the case of a direct AC LED) or the electronic driving systems (in the case of a DC LED system). Therefore in a preferred embodiment of this invention a power line conditioner device is utilised to improve the quality of the power that is delivered to the downlighting illumination system. Power or line conditioners regulate, filter, and suppress noise in AC power for sensitive solid state equipment. Power conditioners typically consist of voltage regulators in combination with output isolation transformers and transient voltage suppression circuitry. They provide electrical isolation and noise and spike attenuation to ensure the quality and consistency of power to sensitive high technology equipment. The voltage regulator specifications will include a suitable power rating, input voltage, output voltage, voltage regulation accuracy, phase, and frequency.

A preferred embodiment of the present invention teaches that the light emitting source should have an appropriate thermal conductivity and dissipation means in order to ensure reliable, robust and increased lumen maintenance operation of the downlighting illumination system. In one aspect of the invention the light emitting source may comprise of one or more light emitting devices that are thermally connected to a metal or ceramic based printed circuit board which inturn is thermally connected to a passive heatsink which may or may not have active thermoelectric devices attached to improve thermal transfer of heat from the light emitting source to its surrounding environment. In some embodiments the passive heatsink may contain heatpipe technology to aid the transfer of heat away from the light emitting source. In further embodiments the active thermoelectric device may be a piezoelectric actuating device that generates airflows across the surface of the heatsink to increase thermal transfer or a controlled fan system.

A further aspect of the present invention is to utilise a light emitting source that contains at least one high power (>1

Watt) LED emitter package that may contain one or more light emitting elements. The LED emitter package may be of a type that can be energised using either a DC or AC voltage depending on user or system requirements. The LED emitter package(s) may be arranged into an ordered or pseudo-ordered array of light emitters in order to optimise the light exiting the output aperture of the reflector system.

A further preferred embodiment of the present invention relates to an electronic driving system that is capable of controlling the light output characteristics of the light emitting source. The light output characteristic may describe one or more of the following:

- the intensity of the illumination system;
- the power spectral density of the illumination system;
- the correlated colour temperature of the illumination system;
- the colour rendering index of the illumination system;
- the beam angle of the illumination system.

Preferably, the electronic driving system is able to utilize a microprocessor, programmable system on a chip, FPGA (Field Programmable Gate Array), ASIC (Application Specific Integrated Circuit) or alternative device that is capable of computing information or data to calculate control parameters of the light source. Furthermore, said electronic driving system is preferably able to utilize and implement feedback and feedforward control systems to rapidly react to information provided by feedback sensors in order to modulate the characteristics of the light emitting source. Such feedback sensors could include but is not limited to optical, colour, temperature, timer, occupancy, current, voltage, power, gas, magnetic, vibration, acceleration, velocity, frequency and biological means of monitoring or detecting environmental conditions. Said electronics driving system will also include a switching means that controls the activation and deactivation of the light emitting source. For example, the switching means may activate the light emitting source by limiting the current to a suitable activation level, for instance 1 mA, and deactivate the light emitting source by limiting the current to a suitable deactivation level, for instance 0 mA. The switching means may be controlled by PWM (Pulse Width Modulation), PAM (Pulse Amplitude Modulation), PFM (Pulse Frequency Modulation) or any other modulation technique. Alternatively, the switching means may be controlled using a constant current control means, for example DC means or continuous AC means.

One aspect of the current invention is the development of a mechanical means for securing the position of the said illumination system. A preferred embodiment of the mechanical means would include the use of a spring system attached to the downlighting illumination system which enables a pressure fit system enabling the illumination system to remain flush to the ceiling. A further embodiment of the mechanical means would be to provide a housing surrounding the illumination system which may be fixed in position by a variety of means.

According to a second aspect of the invention, there is a system according to the first aspect of the invention with a light emitting source comprising of single or multiple light emitting packages containing one or more light emitting elements capable of radiating a single colour, which includes white, or a plurality of colours. The light emitting source may comprise one or more LED strings. In at least one embodiment, the light emitting source comprises at least two LED strings comprising a string of LEDs that emit a first colour wavelength spectrum and a string of LEDs that emit a second colour wavelength spectrum. In one preferred arrangement, the light emitting source comprises at least three LED strings, typically a string of LEDs that emit a first colour, for example red, a string of LEDs that emit a second colour, for example green and a string of LEDs that emit a third colour, for example blue. Each LED string may comprise any number of LEDs, however, in typical light emitting sources there are 9 (3 x Red, 3 x Green, 3 x Blue) or 36 (12 x Red, 12 x Green, 12 x Blue) LEDs. This has particular benefit for colour displays however additional strings of different coloured LEDs would provide the downlighting illumination system with a configurable and uniform power spectral density light output. Alternatively, the light emitting source comprises one or more white LED strings or LED strings having other colour LEDs, for example orange, amber or red LEDs to enable precise control of the light emitting source CRI and CCT outputs. The reflector that extends the apparent source size of the light emitting source enables multiple configurations of LED strings and thereof LED colours whilst still maintaining a near uniform illuminance, CCT and CRI.

According to a third aspect of the invention, there is provided a light emitting source wherein said light emitting source comprises an array of light emitting diodes connected to a thermally conductive printed circuit board and appropriately matched thermal load dissipation system via low thermal resistant materials. The low thermal resistant materials used as an interface between thermally active components within the downlighting illumination system may include:

- Ceramic-based thermal grease usually composed of a ceramic powder suspended in a liquid or gelatinous silicone compound, which may be described as 'silicone paste' or 'silicone thermal compound'. The most commonly used ceramics are: beryllium oxide, aluminium nitride, aluminum oxide, zinc oxide, and silicon dioxide.
- Metal-based thermal grease containing solid metal particles (usually silver).
- Carbon based thermal grease including diamond powder or short carbon fibers.
- Liquid metal based thermal pastes containing liquid metal alloys of gallium.
- Thermal pads also called phase-change materials.
- Thermal adhesive such as a type of thermally conductive glue The thermal load dissipation system may include heatsink designs made from aluminium, copper, ceramics or other low thermal resistance materials with high conductivity values. In addition the thermally conductive printed circuit board may be manufactured from a Metal Core Printed Circuit Board (MCPCB), Direct bonded copper (DBC) substrates, Insulated metal substrate (IMS) or a ceramic substrate.

According to a fourth aspect of the invention, there is provided a light emitting source wherein said light emitting source comprises an array of light emitting diodes bonded directly to the downlighting illumination system housing or thermal heatsink to ensure the light emitting source thermal resistance is minimised. Note that the light emitting diodes could be bonded using either DBC or IMS bonding techniques to enable very small thermal resistance of the illumination system of much less than 1° C./W. Such an aspect would enable improved light output performance, illumination efficacy, reliability and lumen maintenance of the downlighting illumination system.

A fifth aspect of the invention provides a means for diffusing light emitted by said light emitting source located at or close to the output aperture of the reflector. The diffusing means may provide a degree of light mixing or colour mixing of individual light elements of the light source. The diffusing means may comprise at least one light shaping diffuser which may be translucent. Alternatively, the diffusing means comprise any suitable light scattering means such as phosphor conversion or quantum dot technology whereby an image(s) of the light source is not seen at the output aperture of the reflector. The diffuser may improve further the uniform illuminance of the downlighting illumination system and provide improved CCT, CRI distribution across the area to be illuminated by the downlight. The diffuser would be typically manufactured from glass or polymeric sheet materials and have a certain degree of diffusion on one or two sides of the sheet. It is important to note that the degree of diffusion would affect the overall light output ratio (LOR) of the downlighting illumination system with a heavy diffuser reducing the LOR whilst a clear sheet would have a minimal effect on the overall LOR. The diffuser could be manufactured with one or more surfaces containing random and pseudorandom micro and nanostructures which effectively provide defined diffusion characteristics with high light transmission properties. It is suggested that light shaping diffusers using nanostructures can have light transmission efficiencies in excess of 90% meaning the downlighting illumination system would maintain a high LOR.

In this aspect it is also possible to provide a further embodiment of the invention whereby the means for diffusing light emitted by said light emitting sources is located between the said light emitting source(s) and the output aperture of the reflector.

A sixth aspect of the invention provides a translucent means for diffusing light consists of polymeric or glass material which contains or is coated with single or multiple nanomaterial phases or layers such as quantum dots or phosphor materials to provide wavelength conversion and diffusion from at least one wavelength distribution of light to another. In this aspect of the invention a polymer or glass sheet may be coated with either an organic or inorganic composite phosphor to convert the first wavelength distribution light emitted by the light emitting source into a second desired wavelength distribution. For example, the light emitting source may contain an array of high power blue LEDs and the diffuser may contain a phosphor coating (such as Cerium(III)-doped Yttrium aluminium garnet) on the surface nearest the light emitting source which absorbs the blue wavelength emitted by the light emitting source and emits in a broad range from greenish to reddish, with most of the output in yellow to produce a white light. As the diffuser is situated well away from the heat generated by the light emitting source the blue light may be converted by the phosphor with an efficiency of greater than 80% and improved phosphor lifetimes will be exhibited. It may also be possible to use a semi-transparent phosphor rather than a diffuse phosphor layer to allow light generated by white LEDs to pass through with minimal deflection whilst enabling improved CRI and CCT characteristics by converting more of the blue part of the LED generated white light spectrum into the red wavelength region. The use of quantum dots can also provide a similar effect to that of phosphors and the larger the dot, the redder (lower energy) its fluorescence spectrum. Conversely, smaller dots emit bluer (higher energy) light. Quantum dots are particularly significant for optical applications due to their theoretically high quantum yield, the ability to tune the size of quantum dots is advantageous for many applications and enables accurate rendering of colours to the response curve of the human.

A seventh aspect of the present invention utilises a reflector that contains a highly polished inner surface to provide specular reflections that virtually extends the apparent light emitting source size. The highly polished specular inner surface reduces light reflection losses from the surface of the reflector and enables improved LOR performance by creating multiple virtual imaging of the light emitting source over an extended aperture area.

In an eighth aspect of the invention, the reflector may contain a series of faceted surfaces to improve upon the virtually extended apparent light emitting source size.

In a ninth aspect of the invention, the reflector could contain two or more defined sections that have curves described by but not limited to ellipse, parabola, hyperbola and cycloid equations. One or more surfaces could include a diffusion surface to further enhance the uniform output.

In a tenth aspect of the invention, the reflector further comprises of a means to join with the thermal conductivity and dissipation described in the downlighting illumination system using a suitable thermal interface material to extend and increase the thermal dissipation surface area. Providing the reflector was manufactured using a metal such as aluminium then it would offer a considerable increase in surface areas to enable improved thermal management of the light emitting source. Such an aspect is important, as most downlighting illumination systems are enclosed in a recessed ceiling and so the light emitting source and thermal dissipation means (eg; heatsink) are contained above the ceiling. The use of the metal reflector enables heat generated by the light emitting source to conduct along the reflector's inner and outer surface providing an omnidirection heat transfer system that enables heat to transfer into free air that moves into the reflector via the reflectors output aperture as well as heat dissipated by the illumination system above the ceiling.

In an eleventh aspect of the invention, the reflector further comprises of a means to attach a bezel to reduce the thermal resistance and increase the surface area of the thermal conductivity and dissipation means. Such a means would enable the bezel to be easily attached and detached to allow for different bezel styles or colours whilst also providing for a method to attach, place or retain the translucent diffuser means at or close to the output aperture of the reflector. Providing the bezel is made from aluminium or other suitable metals then its thermal contact with the reflector would still further extend the surface area of the thermal dissipation means of the downlighting illumination system.

In an twelfth aspect of the invention, the downlighting illumination system comprises a closed loop feedback system arranged to cause the precise control of the colour, intensity, frequency, CCT, CRI and power spectral density of light emitted through the output aperture. The feedback means is capable of measuring temperature, current, voltage, power, intensity and colour of the light emitting source along with other environmental parameters that are measured in the vicinity of the illumination system through a sensor network.

In at least one embodiment, the light emitting light source may be configured for manually or automatically controlling a magnitude of the intensity of the light emitting source. For example, the light emitting source may electrically cooperate with a mains dimmer.

In at least one embodiment, a door opening sensor, occupancy sensor, optical sensor, colour sensor or user operated wireless remote control may be employed that electronically controls the light emitting source to a desired outcome.

In a thirteenth aspect of the invention, the downlighting illumination system comprises a mechanical means for securing the said system using one or more retaining springs to hold the fixture in a recessed position and flush against the ceiling. A further embodiment could include a mechanical means that comprises of a housing having at least one side and/or a top having an interior surface connected to the light emitting source, reflector and power source and electronic driving system.

The power source may be powered by a power supply or transformer that is preferably attached directly or remotely to the fixture. The power source may be an AC to DC power supply, a DC to DC power supply, an AC to AC power supply or any other suitable power supply.

The feature(s) according to the different aspects of the invention may be employed separately or in combination with any other feature(s) described herein including, but not limited to, any feature(s) according to other aspects of the invention

BRIEF DESCRIPTION OF THE DRAWINGS

The present invention will now be described, by way of example, with reference to the accompanying drawings in which:

FIG. 4*a* illustrates the input aperture of the reflector and two separate curves whilst FIG. 4*b* illustrates the exit aperture of the reflector, the entrance aperture rim for connecting to the thermal conductivity and dissipation means, the exit aperture rim for connecting to a bezel that positions and holds a diffuser and slots which enable the bezel to connect to the reflector and turn to secure its position.

FIG. 5*a* illustrates one of three holes used for enabling an enlarged diffuser to be dropped below the bezel to provide a stylised function. FIG. 5*b* illustrates one of three retaining nodes that enables the bezel to be lined up with the complementary reflector slots enabling the bezel to be pushed against the reflector rim and rotated to lock the bezel in place.

FIG. 8*a* illustrates how a light emitting source containing an array of blue LEDs can be converted in white light at the reflector output aperture by using either an organic or inorganic compound phosphor plate. FIG. 8*b* illustrates how a light emitting source containing an array of cool white LEDs can be converted into a warm white, high CRI, light at the reflector output aperture by using specifically tuned quantum dots.

DETAILED DESCRIPTION OF THE INVENTION

Figure 1:
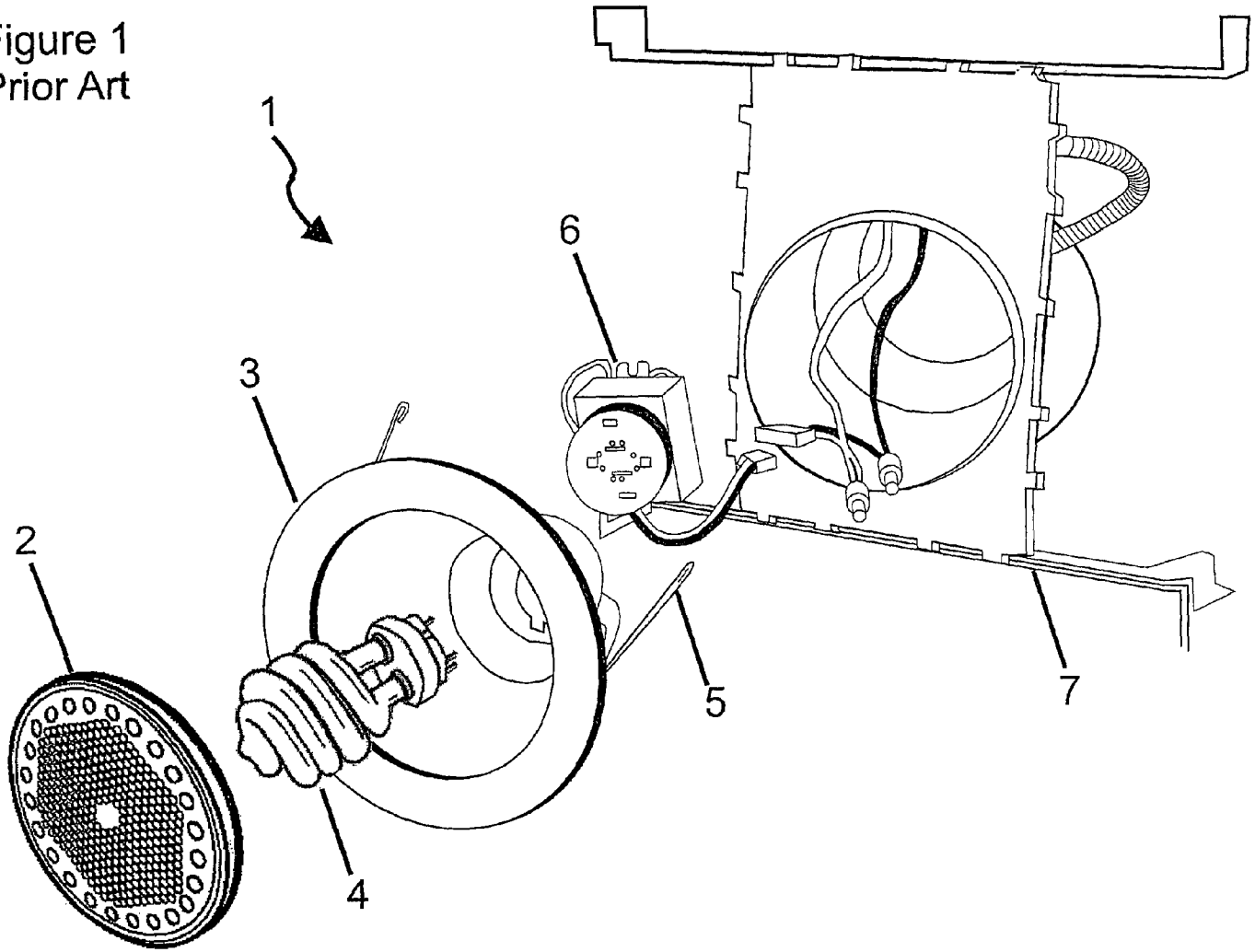
Figure 1 Prior Art
FIG. 1 illustrates a prior art CFL based downlighting luminaire.

FIG. 1 shows a prior art CFL downlighting luminaire (1) which includes a diffuser (2) connected to a reflector (3) that houses a CFL lamp (4). The CFL (4) is connected to a CFL ballast (6) used to power the CFL lamp. The combined reflector (3), CFL lamp (4), diffuser (2) and CFL ballast (6) are connected and retained in the downlighting ceiling chassis (7) using retaining clips (5). Such CFL downlighting luminaries have very low LOR figures and as CFL lamps contain hazardous materials such as mercury they are not environmentally friendly.

Figure 2:
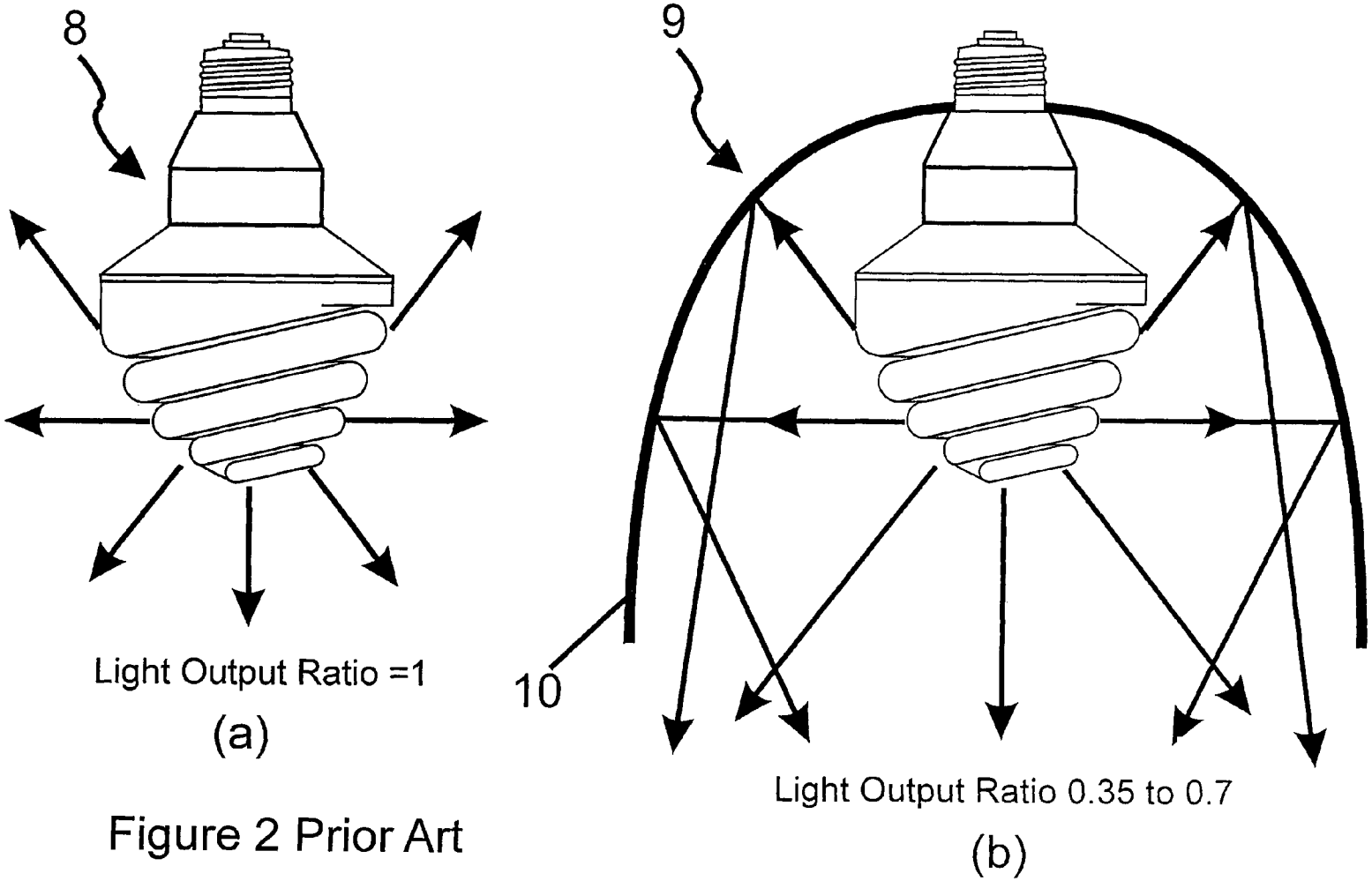
Figure 2 Prior Art
FIG. 2 illustrates how an omnidirectional light source such as a CFL reduces the light output ratio when it is used as a directional light source application.

FIG. 2*a* shows that a CFL lamp (8) emits light in an omnidirectional manner and therefore solely as a bulb the light output ratio would equal 1. However, FIG. 2*b* demonstrates that a collimated CFL based downlighting luminaire (9) utilising a reflector (10) to collimate the omnidirectional light from the CFL lamp becomes highly inefficient and the light output ratio for typical systems range from just 0.35 to a maximum of 0.7. It is important to note that the light output ratio of a CFL downlighting luminaire decreases as its beam angle decreases or as the output aperture of the luminaire decreases. In order to main a degree of energy efficiency over incandescent lamp downlighters, CFL based luminaries tend to have large reflector output apertures that cause glare and look unsightly.

Figure 3:
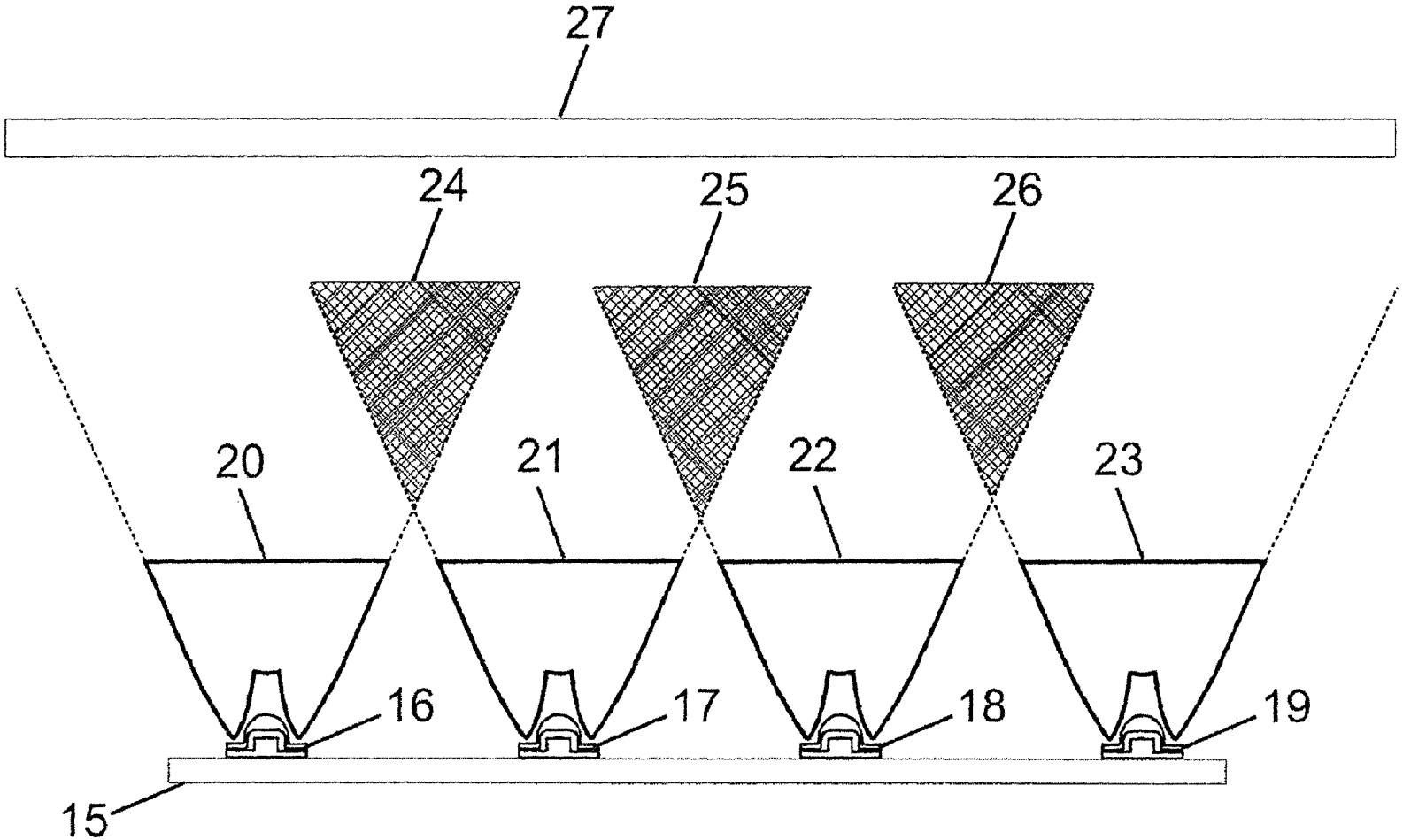
Figure 3 Prior Art
FIG. 3 illustrates a prior art LED based light emitting source showing an array of LEDs each with individual TIR collimating optics producing overlapping beam outputs that cause intensity variations in overlapping regions, fringing effects for objects placed in the near- or far-field due to separate, discrete illumination points as well as increased user glare.

FIG. 3 shows a prior art LED based lighting system that contains a metal core printed circuit board (15) upon which an array of four LED emitters are placed (16 to 19). Each LED emitter has a corresponding TIR optical collimating lens (20 to 23) that is used to collimate the light output from each LED within the array to produce a defined beam pattern. As the beam pattern from each individual collimating optic propagates to the far field they start to superimpose to cause intensity variations in overlapping regions (24, 25, 26); fringing effects for objects placed in the near- or far-field due to separate, discrete illumination points as well as increased user glare. Even with the use of a diffuser (27) placed in front of the LED array the output of the lighting system is not uniform in brightness, colour, CCT or CRT due to largely discrete light emitters that have relatively small apparent aperture sizes. Such LED systems are typical for architectural colour changing luminaires however they do not exhibit a high enough quality or consistency in the output beam for commercial, architectural, retail or other high quality applications.

Figure 4:
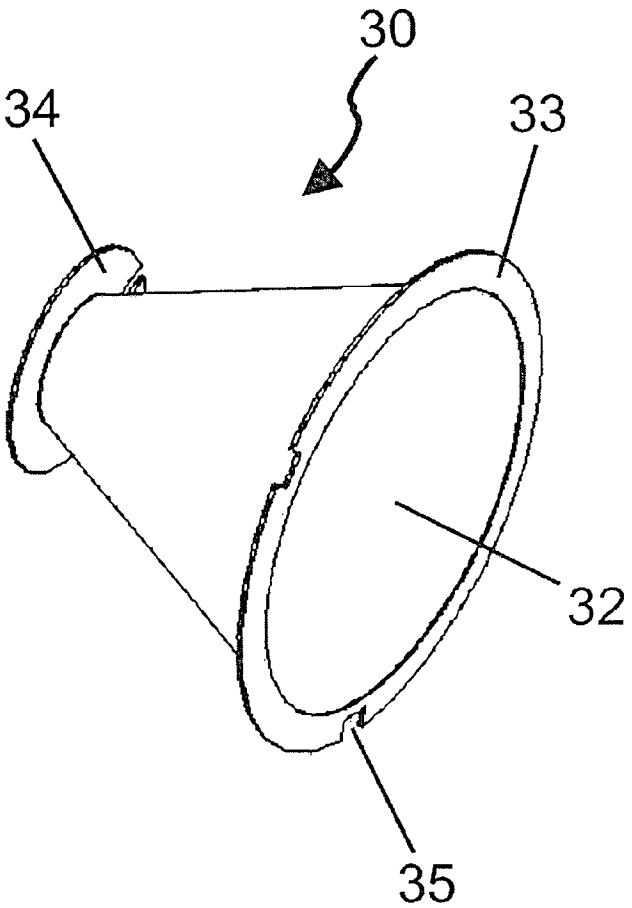
FIG. 4 illustrates two different perspective drawings of a typical reflector used within the downlighting illumination system.
Figure 4:
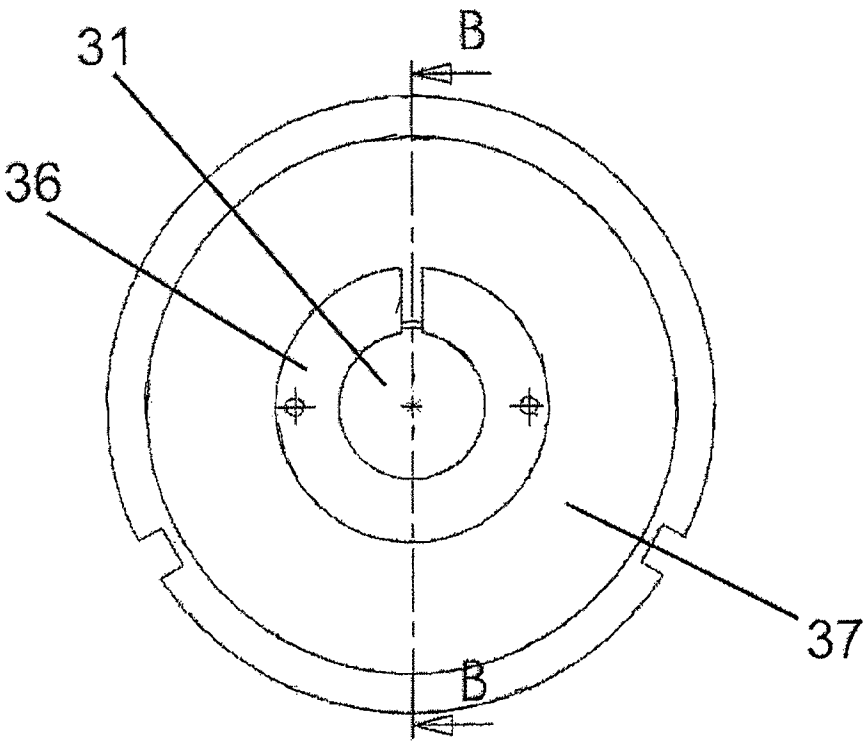

FIG. 4*a* illustrates a perspective drawing of a typical reflector (30) used within the downlighting illumination system invention. The figure illustrated the input aperture (31) of the reflector (30) and two separate and different curved surfaces, the nearest to the light source being identified as 36 and the outer curve being closest to the reflector output aperture (32) being identified as 37. In order to improve the extended aperture imaging one or more of the curved surfaces could be faceted either radially or longitudinally. Furthermore, one or more of the surfaces could be manufactured to provide diffusing of the light emitting source to enable improved uniformity of the luminaire. In FIG. 4*b*, the reflector (30) is shown with an output aperture (32) where light from the light emitting source exits from the reflector (30). The input aperture (31) of the reflector (30) contains a rim (34) used to connect the reflector (30) to the thermal conductivity and dissipation means of the downlight. The output aperture rim (33) is for the connection of a bezel that positions and holds a diffuser and slots (35) cut within the reflector (30) enables the bezel to push connect to the reflector (30) and turn to secure its position. The reflector (30) is usually made from a highly polished metal and many cases this will be aluminium although other metals and materials may be used. The surfaces of the reflector (30) may be described by a mathematical equation which could take the functional form of a parabolic, aspheric, linear or other equation depending on the desired beam angle output of the downlighting illumination system. The functional design of such a reflector (30) enables easy assembly of the bezel to the reflector system enabling the bezel to be easily removed to place a diffuser at or close to the output aperture (32) and then replaced to secure the diffuser in place.

Figure 5:
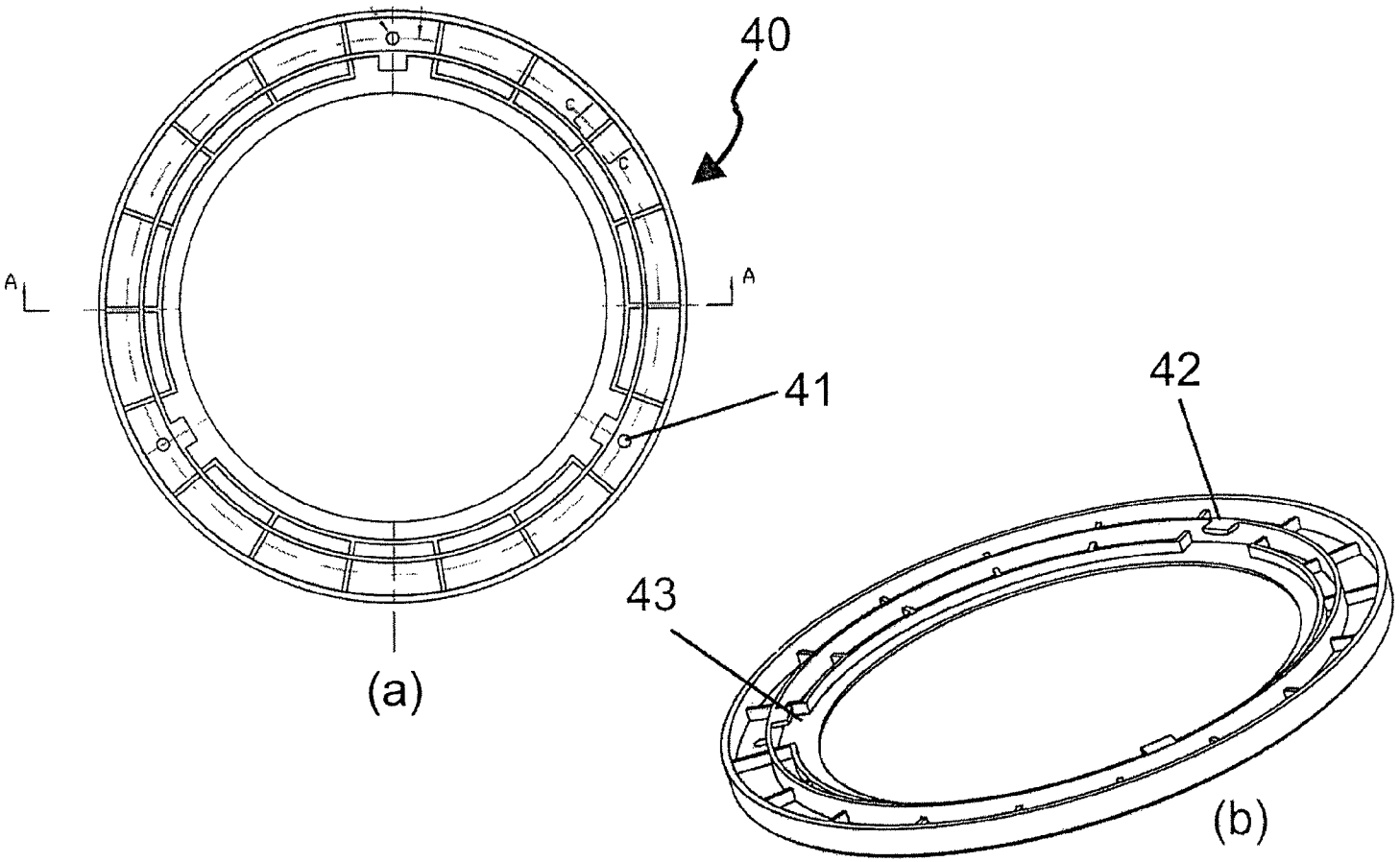
FIG. 5 illustrates two different perspective drawings of a typical bezel used within the downlighting illumination system.

FIG. 5 illustrates a perspective drawing of a typical bezel (40) used within the downlighting illumination system invention. The bezel (40) could be made from a variety of material such as a polymer, composites or indeed one of any number of metals. Preferred embodiments of the bezel would be in aluminium to enhance the overall thermal management properties of the downlight system or a fire resistance polymer to help reduce weight.

FIG. 5*a* illustrates one of three holes (41) used for enabling an enlarged diffuser to be dropped below the bezel (40) to provide increased diffusion as well as providing a certain stylised function. FIG. 5*b* illustrates one of three retaining nodes (42) that enables the bezel to be lined up with the complementary reflector slots (35) enabling the bezel (40) to be pushed against the reflector rim (33) and rotated to attach and lock the bezel (40) in place. The inner rim (43) of the bezel (40) provides enough space to place a light diffuser disc within the bezel (40).

Figure 6:
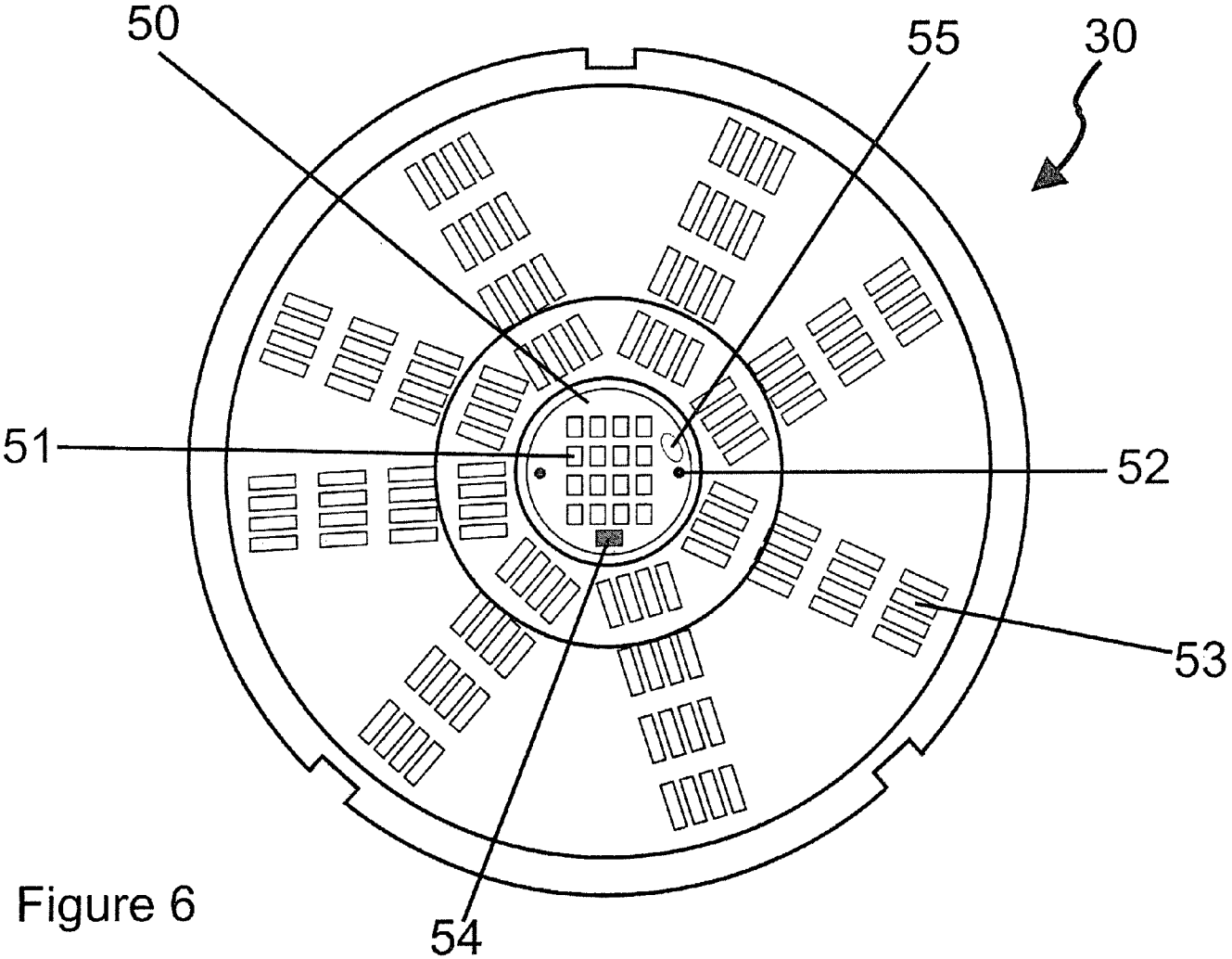
FIG. 6 illustrates the effect of virtually extending the apparent source size of the light emitting source to fully illuminate the output aperture by looking directly through the reflector at the light emitting source. Multiple virtual images of the light source light emitting elements are displayed across the inner surface of the reflector.

FIG. 6 shows the effect of virtually extending the apparent source size of the light emitting source (50) to fully illuminate the output aperture (32) by looking directly through the reflector (30) at the light emitting source (50). The light emitting source (50) in this embodiment is an array of 16 high brightness LEDs (51) closely packed together to provide a high optical power density with a small apparent source size. Multiple virtual images (53) of the light source (50) light emitting elements (51) are displayed across the inner surface of the reflector (30) providing an excellently uniform beam output of the downlight. The appearance of virtual light emitting elements (53) helps reduce glare and enables the light source to take on an appearance similar to conventional halogen lamps which is well perceived by consumers. FIG. 6 also shows a temperature measuring device (54) attached to the light emitting source (50) in order to measure the temperature of the light emitting source (50) and by association the junction temperature of LEDs (51) contained within the array. In other embodiments the light emitting source (50) may contain a single light emitting element placed in the centre of the reflector (30) or an array of LEDs (51) that contain a combination of colours in order to provide accurate control of CCT and CRI over a defined range. FIG. 6 also shows an embodiment of the current invention whereby a colour sensor (54) that may be calibrated to the CIE photopic response curves of the human eye is used to provide accurate control of brightness, colour, CCT and CRI over a defined range. For example, CCT may be controlled across a range between 2200K and 10000K and CRI may be maintained at its nominal rate typically greater than 75. Other embodiments may replace the colour sensor with a photodiode to provide a lesser degree of CCT, CRI and brightness control. FIG. 6 also shows one of two mounting holes (52) used to pressure mount the light emitting source (50) on to the heatsink using standard screws. The invention enables different light emitting elements (51) containing different colours to be used within the downlight without compromising the uniformity of the beam output. For example, the LED array could be made up of 12 white LEDs, 2 red LEDs and 2 amber LEDs to create a high CRI white downlight. In conventional configurations such as shown in FIG. 3 the beam output would contain an uneven area of red and amber in the output beam according to where the red and amber LEDs are geometrically placed in the array however the current invention creates multiple virtual images (53) to extend the apparent source size of all the light emitting elements (51) in the light emitting source (50) thus providing a much improved uniform beam output.

Figure 7:
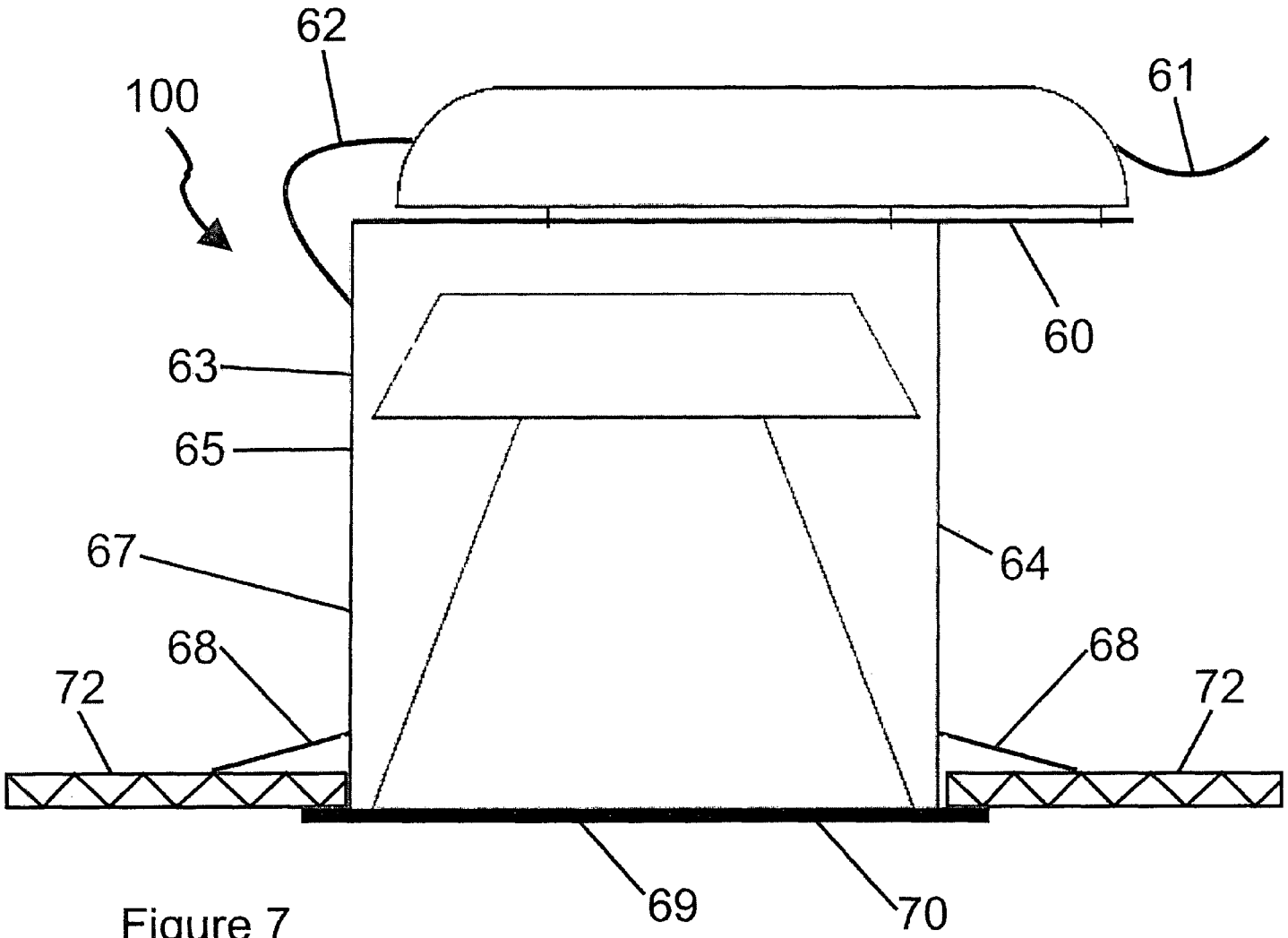
FIG. 7 illustrates one typical embodiment of a downlighting illumination systems installed in a typical recessed ceiling application.

FIG. 7 shows a preferred embodiment of a DC LED based downlighting illumination systems (100) installed within a typical recessed ceiling (72) application. The system (100) comprises of an electronic driving system (60) to control the light output characteristics of the light emitting source (50). The light emitting source (50) is shown as a metal core PCB (65) containing an array of high power light emitter packages such as LEDs (66). In this embodiment the electronic driving system (60) combines a means for controlling the power factor and the power quality to the system (100) to enable the downlighting system (100) to be efficient, reliable and robust against transient voltage variations of the AC power source (61). The electronic driving system (60) is connected to the light emitting source (50) by LED power and sensor signal cables (62). The light emitting source (50) is attached using a high thermal conductivity interface tape (64) to an appropriate dissipation means which in this embodiment is provided by an aluminium heatsink (63). The reflector (67) is attached to the heatsink (63) via the high thermal conductivity interface tape (64) to improve the overall heatsink surface area which will improve the downlighting illumination system (100) performance. The downlighting system (100) is held in place above the ceiling (72) using two or more retractable springs (68) that applies pressure to the downlight by pushing the spring down onto the upper surface of the ceiling. In order to remove the downlighting system (100) from the ceiling (72) the springs (68) can be removed or held back allowing the downlighting system (100) drop through the ceiling aperture. Such a system enables the downlight system (100) to be rapidly installed and decommissioned without the need for complex tools or specialist training. The aluminium bezel (70) sits flush against the lower surface of the ceiling (72) providing an excellent fit whilst an optional diffuser (69) enables improved beam characteristics. In a further embodiment of the present invention a gasket may be placed between the bezel (70) and the lower surface of the ceiling (72) to improve fire and smoke permeability and offer better protection. The downlighting system (100) shown in this embodiment will usually offer an LOR well above that achieved with any omnidirectional light source and is typically in excess of 0.75 and more preferably in excess of 0.8. Therefore an embodiment using LEDs will require significantly less power than a CFL version offering improved total cost of ownership and being better for the environment. The electronic driving system (60) should also contain a microprocessor, programmable system on chip, FPGA or other means to monitor the optical, current and temperature sensors in order control the power spectral density of the light emitting source (50).

Figure 8:
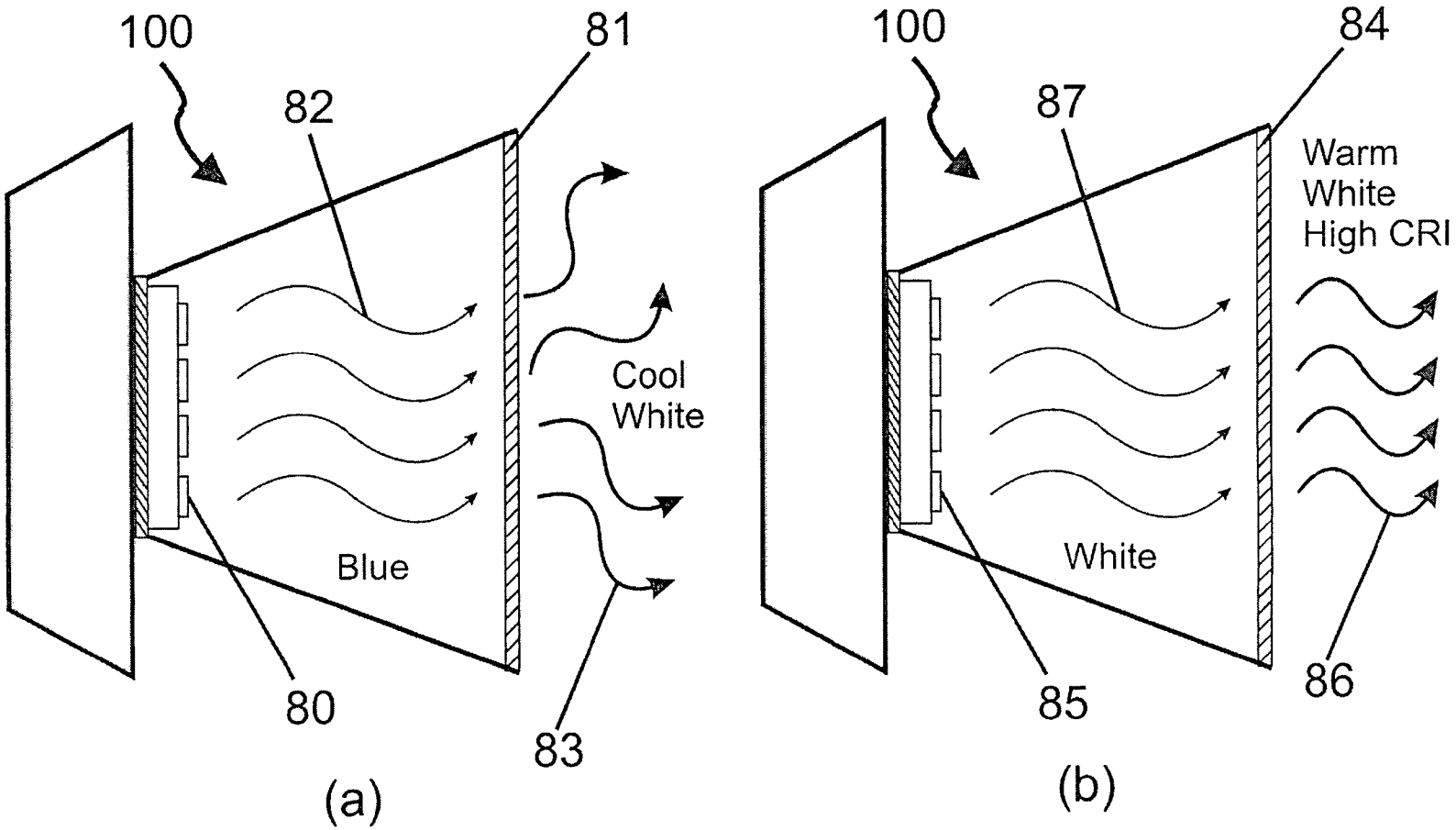
FIG. 8 illustrates two different embodiments of the downlighting illumination system that uses remote phosphor or quantum dot technologies that are coated or impregnated into a polymeric sheet.

FIG. 8 shows two different embodiments of the downlighting illumination system (100). FIG. 8*a* illustrates how a light emitting source (50) containing an array of blue LEDs (80) can be converted into a cool white light (83) that is diffused at the reflector output aperture (32) by using either an organic or inorganic compound phosphor plate (81). Such an embodiment offers certain advantages such as improved lumen maintenance of the illumination system (100) because the light emitting source (50) contains only blue LEDs (80) and the phosphor conversion to white light is done remotely using the phosphor plate (81). The remote phosphor plate (81) may be manufactured to have the phosphors coated onto one or more surfaces or impregnated into a polymeric sheet. As the phosphor is remotely situated away from the temperature generated by the LEDs (80) the phosphors exhibit improved lifetime and efficiency characteristics providing certain advantages. FIG. 8*b* shows another embodiment where a light emitting source (50) containing an array of cool white LEDs (85) can be converted into a warm white, high CRI, light (86) at the reflector output aperture (32) by using specifically tuned quantum dots. Other embodiments of the present invention would optimise the light emitting source (50) light output characteristics with the absorption characteristics of the phosphor or quantum dots diffusers to yield highly tuned colour systems including white that offer high efficiency light transmission and uniform beam characteristics. Some applications may not require a diffuser. Some embodiments may employ a clear plate.

From another aspect, the present invention provides a downlighting illumination system having a high light output ratio with an extended apparent source size producing a near uniform illuminance, correlated colour temperature and colour rendering index distribution across an illuminated area.

From another aspect, the present invention provides a downlighting illumination system that includes a light emitting source and a reflector arranged to receive light from the light emitting source and to reflect light through an output aperture in a manner that virtually extends the apparent size of the light emitting source to illuminate the output aperture. The system preferably further includes a power source for the light emitting source and an electronic driving system to control the light output characteristics of the light emitting source. The system preferably has a high light output ratio with an extended apparent source size producing a near uniform illuminance, correlated colour temperature and colour rendering index distribution across an illuminated area.

The present disclosure extends to any novel feature or combination of features disclosed herein whether express or implied and to any generalisation thereof.

The invention claimed is:

1. A downlighting illumination system that maintains a high light output ratio greater than 0.75 with an extended apparent source size to provide a near uniform illuminance, correlated colour temperature (CCT) and colour rendering index (CRI) distribution across an illuminated area comprising:

a power source to supply any one of a range of alternated current (AC) or directed current (DC) voltages;

a means for controlling a power factor and a power quality to the system;

a light emitting source with appropriate thermal conductivity and dissipation means;

a reflector comprising a reflective inner surface having an input aperture and an output aperture and arranged to receive light from the light emitting source through the input aperture and to reflect the light through the output aperture in a manner that virtually extends an apparent size of the light emitting source to illuminate the output aperture;

an electronic driving system to control light output characteristics of the light emitting source;

a mechanical means for securing a position of the illumination system.

2. The illumination system according to claim 1 wherein the light emitting source comprises single or multiple light emitting packages containing one or more light emitting elements capable of radiating a single colour, which includes white, or a plurality of colours.

3. The illumination system according to claim 1 wherein the light emitting source comprises an array of light emitting diodes connected to a thermally conductive printed circuit board and appropriately matched thermal load dissipation system via low thermal resistant materials.

4. The illumination system according to claim 1 wherein the light emitting source comprises an array of light emitting diodes bonded directly to an illumination system housing or thermal heatsink to ensure a light emitting source thermal resistance is minimised.

5. The illumination system according to claim 1 wherein the light output characteristic describes one or more of the following:

an intensity of the illumination system;

a power spectral density of the illumination system;

a correlated colour temperature of the illumination system;

a colour rendering index of the illumination system;

a beam angle of the illumination system.

6. The illumination system according to claim 1 wherein the output aperture of the reflector further includes a translucent means for diffusing light emitted by the light emitting source, wherein the translucent means for diffusing light consists of polymeric material which contains or is coated with single or multiple nanomaterials consisting of quantum dots or phosphors to provide wavelength conversion from at least one wavelength distribution of light to another.

7. The illumination system according to claim 1 wherein the reflector comprises a highly polished inner surface to provide specular reflections that virtually extends the apparent light emitting source size, a series of faceted surfaces to improve upon the virtually extended apparent light emitting source size, and two or more curves selected from an ellipse, a parabola, a hyperbola and cycloid equations.

8. The illumination system according to claim 1 wherein the reflector further comprises a means to join with the thermal conductivity and dissipation means using a suitable thermal interface material to extend and increase a thermal dissipation surface area.

9. The illumination system according to claim 1 wherein the reflector further comprises a means to attach a bezel to reduce a thermal resistance and increase a surface area of the thermal conductivity and dissipation means.

10. The illumination system according to claim 1, wherein the light emitting source comprises one or more light emitting diode (LED) strings and the control means comprises means that activates each LED string by limiting a current to a suitable activation level and deactivates each LED string by limiting the current to a suitable deactivation level,wherein the activation and deactivation means are controlled by Direct Current, Alternating Current, Pulse Width Modulation, Pulse Amplitude Modulation, Pulse Frequency Modulation or any other current control technique.

11. The illumination system according to claim 1, wherein the illumination system comprises a closed loop feedback system arranged to cause a precise control of a colour, intensity, frequency, CCT, CRI and power spectral density of light emitted through the output aperture, wherein the feedback system is arranged to measure through a sensor network which is capable of measuring temperature, current, voltage, power, intensity and colour of the light emitting source along with other environmental parameters that are measured externally to the illumination system.

12. The illumination system according to claim 11 wherein the control means comprises a door opening sensor, occupancy sensor, optical sensor, colour sensor or user operated wireless remote control that electronically controls the light emitting source to a desired outcome.

13. The illumination system according to claim 1 comprising the light emitting source with at least two light emitting diode (LED) strings comprising a string of LEDs that emit a first colour wavelength spectrum and a string of LEDs that emit a second colour wavelength spectrum.

14. The illumination system according claim 1, wherein the mechanical means for securing the system comprises one or more springs to hold the fixture in a recessed position and flush against the ceiling.

15. The illumination system according to claim 1, wherein the light emitting source electrically cooperates with a mains dimmer for manually or automatically controlling a magnitude of the intensity of the light emitting source.

16. The illumination system according to claim 1, wherein the mechanical means comprises a housing having at least one side and a top having an interior surface connected to the light emitting source, reflector and power source and electronic driving system if directly connected.

17. The illumination system according to claim 1, wherein a total fixture lumens per watt efficiency is greater than 40 and wherein the power factor correction is equal to or greater than 0.8.

18. The illumination system according to claim 1, wherein the CCT is controlled across a range between 2200K and 10000K and wherein the CRI is maintained at nominal rate greater than 75.

19. The illumination system according to claim 1 wherein a means for diffusing light emitted by said light emitting source(s) is located between the light emitting source(s) and the output aperture of the reflector.

20. A downlighting illumination system that includes a light emitting source comprising one or more light emitting diodes (LEDS) and a reflector having an inlet aperture and an outlet aperture, the light emitting source being located at the inlet aperture whereby the reflector receives all of the light emitted from the light emitting source and reflects the light through the output aperture in a manner that virtually extends the apparent size of the light emitting source to illuminate the output aperture, wherein the system has a total fixture lumens per watt efficiency greater than 40, a power factor correction equal to or greater than 0.8 for the light emitting source, and an electronic driving system to control the light output characteristics of the light emitting source such that correlated colour temperature (CCT) is controlled across a range between 2200K and 10000K and/or colour rendering index (CRI) is maintained at a rate greater than 75.

* * * * *